US006511074B1

(12) United States Patent
Fireman

(10) Patent No.: US 6,511,074 B1
(45) Date of Patent: Jan. 28, 2003

(54) FISH THROWING GAME

(75) Inventor: Andrew F. Fireman, North Bethesda, MD (US)

(73) Assignee: Riva Sports, Inc., Rockville, MD (US)

( * ) Notice: Subject to any disclaimer, the term of this patent is extended or adjusted under 35 U.S.C. 154(b) by 0 days.

(21) Appl. No.: 09/940,069

(22) Filed: Aug. 27, 2001

(51) Int. Cl.[7] ..... A63B 67/00
(52) U.S. Cl. ..... 273/350; 273/440
(58) Field of Search ..... 273/348, 349, 273/300, 402, 440, 441

(56) References Cited

U.S. PATENT DOCUMENTS 3,014,723 A * 12/1961 Butler ..... 273/350
3,095,197 A * 6/1963 Weitzman ..... 200/80 R
3,403,907 A * 10/1968 Keller ..... 273/350
3,895,801 A * 7/1975 Baird ..... 273/350
4,744,565 A * 5/1988 Newberger ..... 210/242.1
5,368,307 A * 11/1994 Hotchkiss ..... 273/350
5,421,585 A * 6/1995 Ruvio ..... 273/338
5,514,023 A * 5/1996 Warner ..... 114/20.1
6,022,024 A * 2/2000 Kahn ..... 273/317
6,264,573 B1 * 7/2001 Zheng ..... 135/125

* cited by examiner

*Primary Examiner*—Mark S. Graham
(74) *Attorney, Agent, or Firm*—Steven N. Fox, Esq.

(57) ABSTRACT

The present invention is a game that may be used by a person in a swimming pool. The game comprises a first target in the form of a hula hoop disposed at the bottom of the pool. The game further comprises a second target in the form of a shark's tank floating on the surface of the water. The game further comprises a hand-held projectile member designed for travel through the water and when thrown properly will travel thru the hoop and upward into the fish tank.

6 Claims, 1 Drawing Sheet

FISH THROWING GAME

FIELD OF THE INVENTION

The present invention relates to an aquatic game that may be used by one or more players in a water environment such as a swimming pool.

BACKGROUND OF THE INVENTION

Many adults and children enjoy playing a game while swimming in a water environment such as a swimming pool. There is a continuing need to develop games for use in a pool that are simply and safe.

SUMMARY OF THE INVENTION

The present invention is a game that may be used by a person in a swimming pool that is fun and easy to play. The game comprises a first target in the form of a hoop disposed at the bottom of the pool. The game further comprises a second target in the form of a tank floating on the surface of the water. The game further comprises a hand-held projectile member in the form of a fish designed for travel through the water. The goal of the game is to throw the projectile so that it passes through the hoop and travels upward into the tank where the projectile is retained.

BRIEF DESCRIPTION OF THE DRAWINGS

The following detailed description of the invention will be more fully understood with reference to the accompanying drawings in which.

DETAILED DESCRIPTION OF THE PREFERRED EMBODIMENTS

Figure 1:
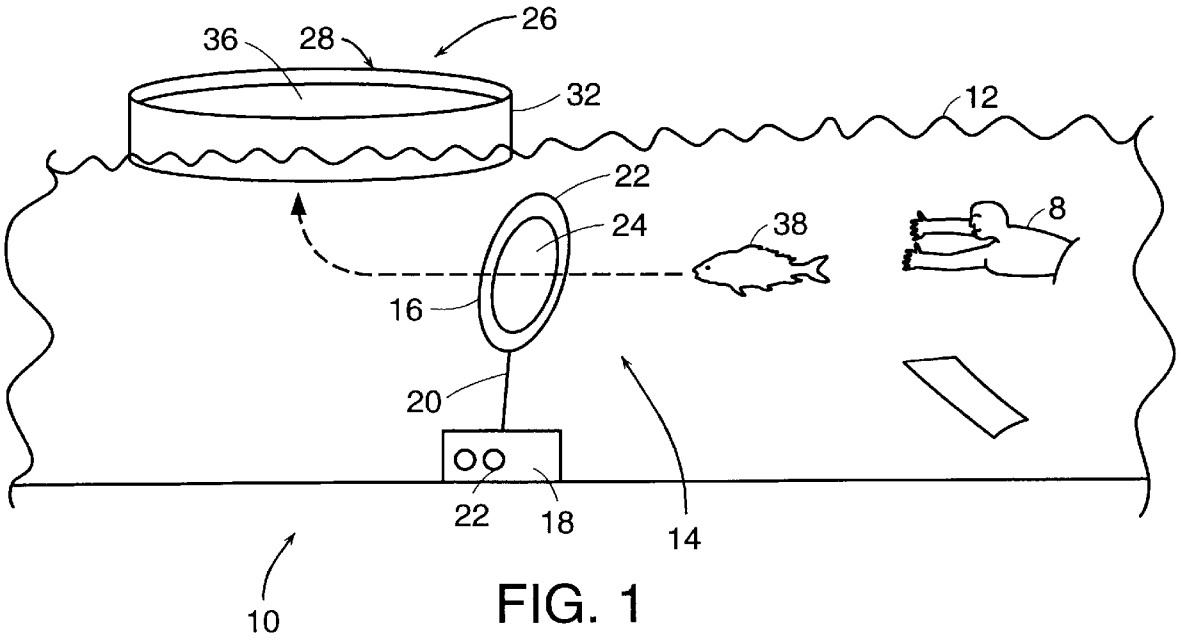
FIG. 1 is a perspective view of the game of the present invention.
Figure 3:
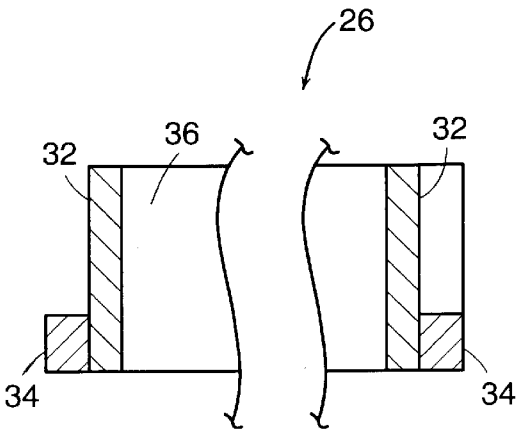
FIG. 3 is cross section view of the second target member.
Figure 2:
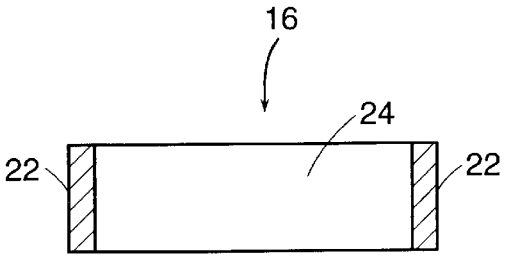
FIG. 2 is a cross section view of the first target member.

Referring to FIGS. 1 and 2, where a game 10 is shown for use in a swimming pool 12. The game 10 generally comprises a first target 14 disposed at the bottom of the pool 12. The first target 14 comprises a hoop 16 connected to a base portion 18 by a support member 20. The base portion 18 comprises a plurality of weights 22 to keep the base portion 18 in contact with the bottom surface of the pool 12. The hoop 16 and support member 20 may take a variety of shapes and be made from a variety of materials that float. The support member 20 may be substantially rigid and shaped like a plastic tube or substantially flexible such as a rope. The 16 may be of circular shape having an annular wall portion 22 defining an opening 24. The hoop 16 extends upward from the base portion to provide a first height. The height of the hoop 16 may be adjustable by for example rotating the hoop 16 about or within the support member 20. Alternatively, the first target 14 may be designed so that it can be disposed at desired depth in the pool 12 without having to be in contact with the bottom of the pool 12.

The game 10 further comprises a second target 26 in the form of a shark's tank 28 floating on the surface of the water 12. The tank 28 has an annular wall 32 defining a closed area or opening 36. The tank 28 may further comprise an annular ring 34 disposed adjacent the lower end of the annular wall 32. The annular ring 34 is made from a material that floats such an styrofoam. The tank 28 may be made from a plastic material and formed by injection molding processes. Alternatively, the tank 28 may simply comprise a cylindrical shaped foam material that floats on the surface of the water and which is closed to capture any projectiles that enter through the water.

The game 10 further comprises a hand-held projectile member 38 designed for travel through the water 12 and when thrown properly will travel thru the opening 24 of the hoop 16 and upward into the opening 36 of the tank 28. An example of a projectile member 38 that may be used in the game 10 is disclosed in U.S. Pat. No. 5,514,023 which is hereby incorporated into this specification by reference in its entirety. The projectile member 16 may be designed with neutral buoyancy and provided with one or more fins 40 that can be used to make the projectile member 38 travel in the desired path. The fins 40 may be adjustable so that the projectile member 38 can travel in different directions.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A game in combination with a pool filled with water, the game comprises:

(a) a first target disposed at the bottom of the pool; said first target comprises a base portion adapted to engage with the bottom of the pool and a hoop member.

(b) a second target floating on the water above said hoop member; and (c) a hand-held projectile member adapted to be thrown thru water and travel thru said first target and upward into said second target.

2. The game of claim 1, wherein said second target comprises a tank member having an annular wall and a bottom opening.

3. The game of claim 2, wherein said hoop member extends upward from said base portion to provide a first height of said hoop member.

4. The game of claim 3, wherein said height of said hoop member is adjustable.

5. The game of claim 4, wherein said base portion comprises a weight.

6. The game of claim 5, wherein tank member and said hoop member are made from a floatation material.

* * * * *